United States Patent [19]

Fukazawa et al.

[11] Patent Number: 4,708,585

[45] Date of Patent: Nov. 24, 1987

[54] CENTRIFUGAL PUMP

[75] Inventors: Tetsuo Fukazawa, Tokyo; Shigeyoshi Yokoyama, Sakura, both of Japan

[73] Assignees: Nihon Radiator Co., Ltd.; Pacific Machinery & Engineering Co., Ltd., both of Tokyo, Japan

[21] Appl. No.: 839,772

[22] Filed: Mar. 14, 1986

[30] Foreign Application Priority Data

Mar. 15, 1985 [JP] Japan ..... 60-50576

[51] Int. Cl.[4] ..... F04D 17/06

[52] U.S. Cl. ..... 415/72; 415/215; 416/176

[58] Field of Search ..... 415/71–74, 415/121 B, 75, 206, 215; 416/176, 177

[56] References Cited

U.S. PATENT DOCUMENTS

| | | | |
|---|---|---|---|
| 2,003,666 | 6/1935 | Moneypenny | 415/72 X |
| 2,600,372 | 6/1952 | Milliken et al. | 415/73 X |
| 3,068,799 | 12/1962 | Lock | 415/72 |
| 3,299,820 | 1/1967 | Campbell | 415/72 |
| 3,442,220 | 5/1969 | Mottram et al. | 415/72 X |
| 3,446,016 | 5/1969 | Boissevain et al. | 415/72 X |
| 3,522,997 | 8/1970 | Rylewski | 415/72 |
| 3,692,422 | 9/1972 | Girardier | 415/121 B |

FOREIGN PATENT DOCUMENTS

| | | | |
|---|---|---|---|
| 478959 | 9/1927 | Fed. Rep. of Germany | 415/72 |

*Primary Examiner*—Robert E. Garrett
*Assistant Examiner*—Joseph M. Pitko
*Attorney, Agent, or Firm*—Kane, Dalsimer, Sullivan, Kurucz, Levy, Eisele and Richard

[57] ABSTRACT

A centrifugal pump including a stationary guide vane secured to a casing, and a centrifugal impeller arranged for rotation in the casing in a position adjacent the stationary guide vane. The centrifugal impeller has at least one blade wound in convolutions on a peripheral surface of a hub and having a blade inlet surface substantially perpendicular to the axis of rotation of the impeller and a fluid flow entrance surface substantially parallel to the blade inlet surface. The blade is wound in a suitable number of convolutions extending from an inlet to an outlet on the hub and is forwardly inclined toward the axis of rotation of the impeller at an increasingly greater angle in going from the inlet toward the outlet, so as to produce centrifugal forces at the outlet. The centrifugal impeller has a high head which has been beyond the power of axial impellers to achieve.

3 Claims, 9 Drawing Figures

CENTRIFUGAL PUMP

BACKGROUND OF THE INVENTION

This invention relates to a centrifugal pump comprising a centrifugal impeller having an inlet substantially similar in configuration to that of an axial impeller.

Generally, an axial impeller has the low head and its specific speed Ns is usually higher than 1000 ($m^3$/min,rpm,m). The state of the art is such that it is impossible for design technology now available to produce an axial impeller having the high head or having its specific speed Ns as low as 200.

SUMMARY OF THE INVENTION

This invention has been developed for the purpose of obviating the aforesaid disadvantage of the prior art. Accordingly, the invention has as its object the provision of a centrifugal pump comprising a centrifugal impeller which, although its inlet is substantially similar in configuration to that of an axial impeller, has the high head.

According to the invention, there is provided a centrifugal pump comprising a casing, a stationary guide vane secured to the casing, and a centrifugal impeller arranged for rotation in the casing in a position adjacent the stationary guide vane, said centrifugal impeller including a hub in the form of frusto-cone and at least one blade wound in convolutions on a peripheral surface of the hub and having a blade inlet surface substantially perpendicular to the axis of rotation of the impeller and a fluid flow entrance surface substantially parallel to said blade inlet surface, said blade being wound in a suitable number of convolutions extending from an inlet to an outlet on the hub and being forwardly inclined toward the axis of rotation of the impeller at an increasingly greater angle in going from the inlet toward the outlet so as to generate centrifugal forces at the outlet, the angle of inclination of the blade with respect to the axis of rotation of the impeller being arbitrarily selected from the range between 0 and 90 degrees.

DESCRIPTION OF THE PREFERRED EMBODIMENT

Figure 1:
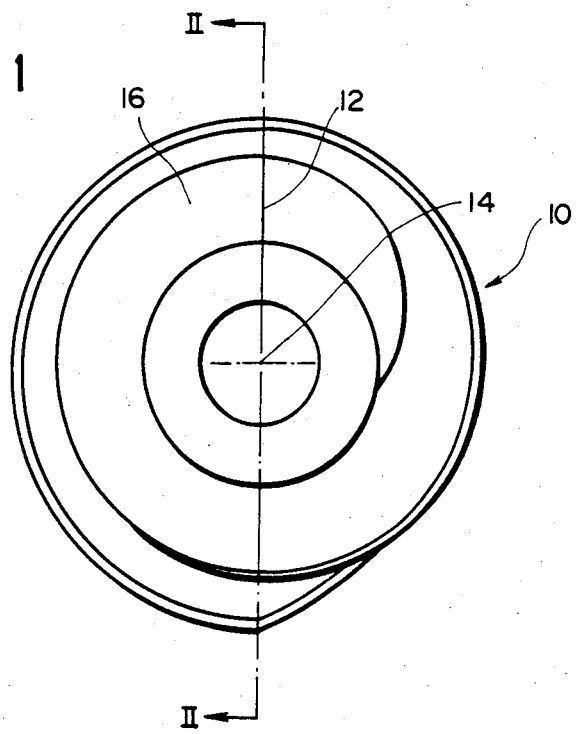
FIG. 1 is a front view of a centrifugal impeller having a single blade according to the invention.
Figure 3:
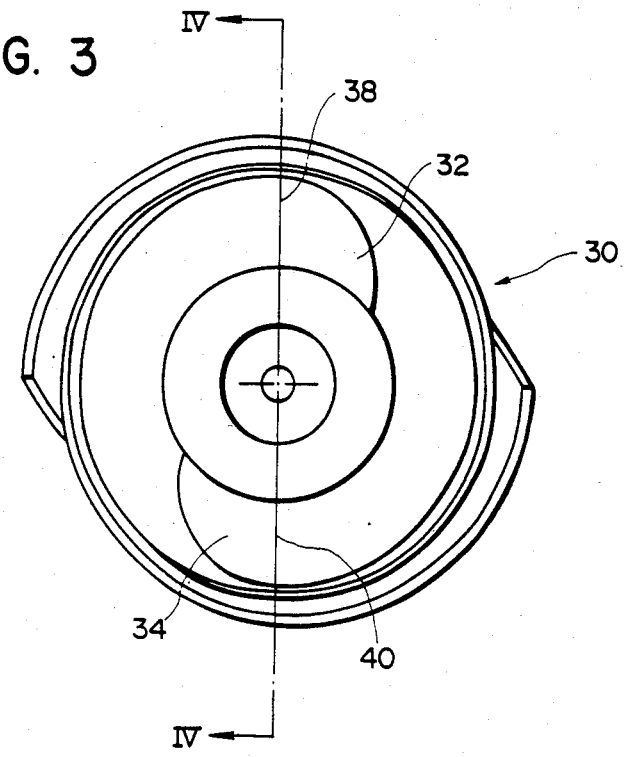
FIG. 3 is a front view of a centrifugal impeller having two blades according to the invention.

FIGS. 1 and 3 show a centrifugal impeller 10 having an axis of rotation 14 comprising a single blade 16 which is wound in more than one convolution.

Figure 2:
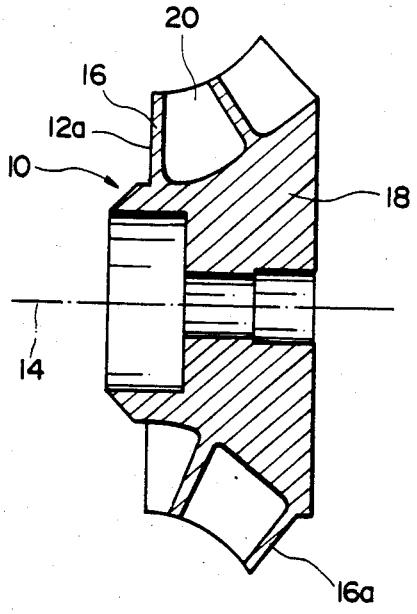
FIG. 2 is a vertical sectional view taken along the line II—II in FIG. 1.

The actual blade inlet of the centrifugal impeller 10 is indicated by a straight line 12, and the portion of the blade 16 extending from the blade inlet 12 to the right as viewed in the drawing of FIG. 1 and merging into the peripheral surface of a hub 18 of the impeller 10 is only an inlet guide for fluid and does not operate as a blade. Practically, the portion of the blade 16 extending spirally counter-clockwise from the blade inlet 12 to a blade outlet **16*a* (FIG. 2) operates as a blade. The surface which is formed by the blade inlet 12 when the impeller 10 rotates is a blade inlet surface 12*a*. Therefore the blade 16 has the inlet surface 12*a* which works to scoop up a cylindrical fluid flow when the impeller rotates, the configuration of the inlet surface 12*a* is nearly perpendicular to the axis of rotation 14, and a fluid flow entrance is substantially parallel to said blade inlet surface 12*a*. The blade 16 of this configuration is formed on the peripheral surface of the hub 18 in more than one convolution from its inlet 12 to the outlet 16*a*. The blade 16 is inclined forwardly toward the axis of rotation 14 at an increasingly greater angle in going from the blade inlet 12 toward the blade outlet 16*a*, so that the hub 18 is frusto-conical in shape and has its diameter increase in going from the blade inlet 12 toward the blade outlet 16*a*. The angle of inclination of the blade 16 may be arbitrarily selected from the range between 0 and 90 degrees with respect to the axis of rotation 14. Convolutions of the blade 16 define on the hub 18 the fluid channel 20** which is nearly equal in area in any cross section.

Figure 4:
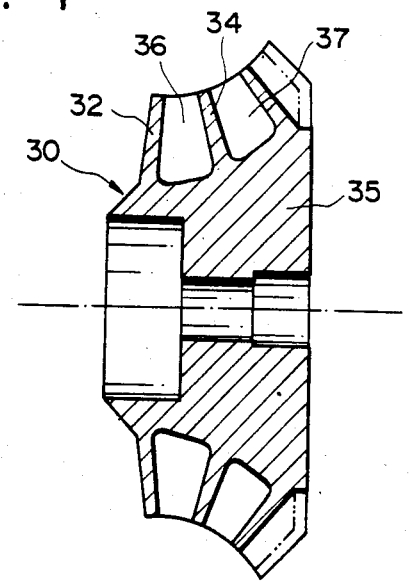
FIG. 4 is a vertical sectional view taken along the line IV—IV of FIG. 3.

FIGS. 3 and 4 show a centrifugal impeller having two blades 32 and 34 according to the invention. Convolutions of the blades 32 and 34 define on the hub 35 fluid channels 36 and 37 extending from blade inlets 38 and 40 to blade outlets and configured nearly equal in area in any cross section. The blades 32 and 34 each are determined in a length such that they have more than one-half convolutions to define the fluid channels 36 and 37. When the impeller has two or three blades, it has the higher head than the impeller of the single blade type.

Although the centrifugal impeller according to the invention is similar in the configuration of its inlet to an axial impeller, the fluid inlet angle is not as great as the incidence angle of an axial impeller. The generated head of an axial impeller is low, but the centrifugal impeller according to the invention has the high head in spite of the configuration of its inlet being substantially similar to that of an axial impeller.

The blade of the impeller according to the invention is somewhat similar in contour (the length of the blade) to the blade of an inducer located in the suction of a centrifugal pump of the prior art. However, the blade of the prior art is basically that of an axial impeller and its head is low. The blade of the impeller according to the invention is also similar in contour to a non-clogging single blade of the prior art. However, the blade of the prior art is distinct in the configuration of its inlet from the blade of the impeller according to the invention.

Figure 5:
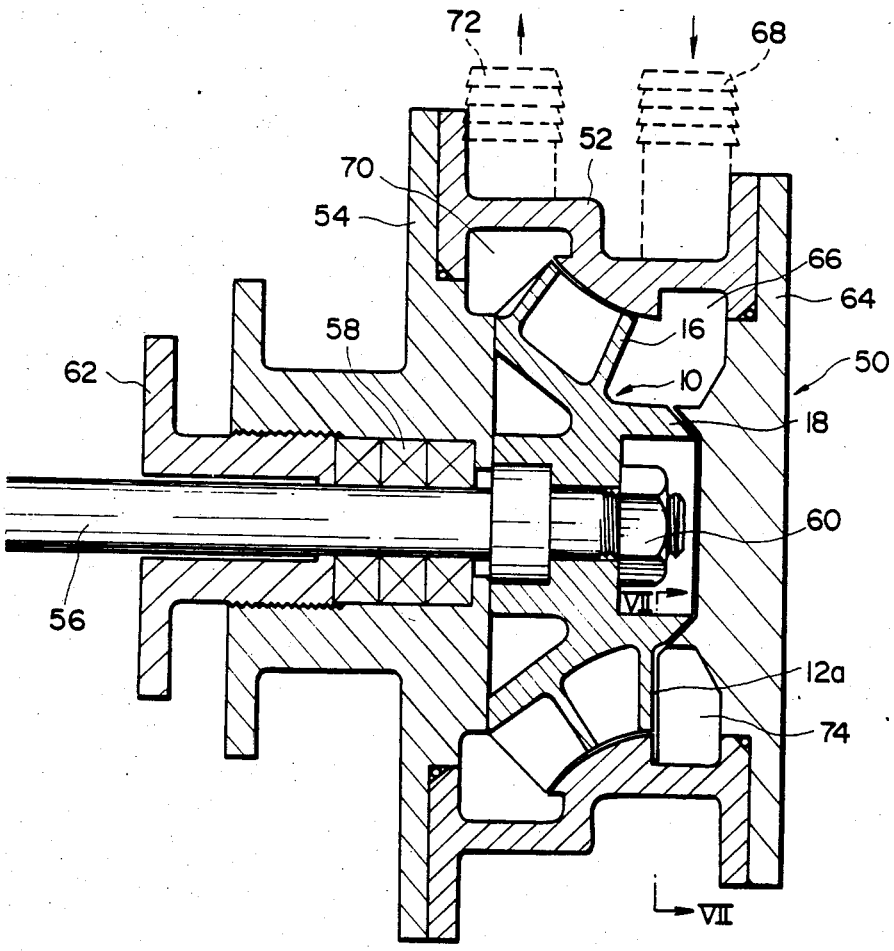
FIG. 5 is a vertical sectional view of the centrifugal pump comprising one embodiment of the invention in which the single blade centrifugal impeller shown in FIGS. 1 and 2 is incorporated.

FIG. 5 shows a centrifugal pump 50 incorporating therein the impeller 10 of the single blade shown in FIG. 1. The centrifugal pump 50 comprises a casing 52 having secured to its left end (as seen in FIG. 5) a bracket 54 for supporting a rotatable shaft 56 through a shaft sealing device 58. The impeller 10 is fastened by a nut 60 to one end of the rotatable shaft 56 extending into the casing 52, and a motor, not shown, is connected to an opposite end of the rotatable shaft 56. A packing gland 62 is threadably fitted in the bracket 54 to hold the shaft sealing device 58. A cover 64 is applied to the left end (as seen in FIG. 5) of the casing 52.

Figure 7:
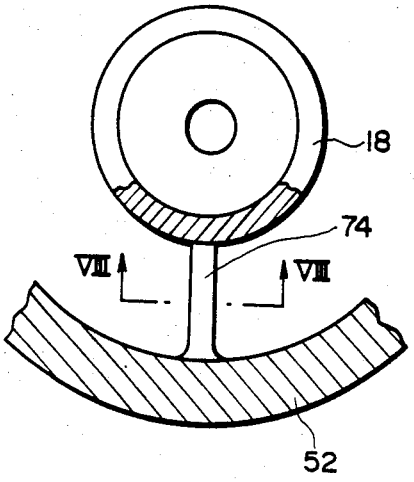
FIG. 7 is a fragmentary sectional view taken along the line VII—VII in FIG. 5.
Figure 8:
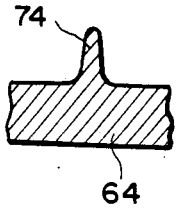
FIG. 8 is a fragmentary sectional view of the stationary guide vane taken along the line VIII—VIII in FIG. 7.
Figure 9:
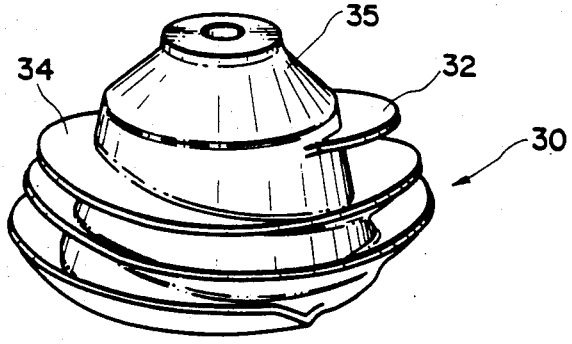
FIG. 9 is a perspective view of the centrifugal impeller of the double blade type according to the invention.

The casing 52 has an inlet port 68 of an annular fluid channel 66 extending along the blade inlet surface 12*a*, and an outlet port 72 located tangentially to an annular fluid channel 70 located adjacent the blade outlet. According to the invention, a stationary guide vane 74 (see FIGS. 7 and 8) extending radially with respect to the axis of rotation of the rotatable shaft 56 is secured to the cover 64 and located immediately before the impeller 10. The stationary guide vane 74 is essential to the centrifugal pump according to the invention, because of the large diameter of the blade 16 at the inlet of the impeller 10, if no stationary guide vane were provided, a fluid flow formed in a cylindrical form at the inlet of the impeller would rotate in the direction of rotation of the impeller. If a rotation of such cylindrical fluid flow occurred, the performance of the pump would be reduced because it would be difficult to slice off the cylindrical fluid flow form at the inlet of the impeller.

Figure 6:
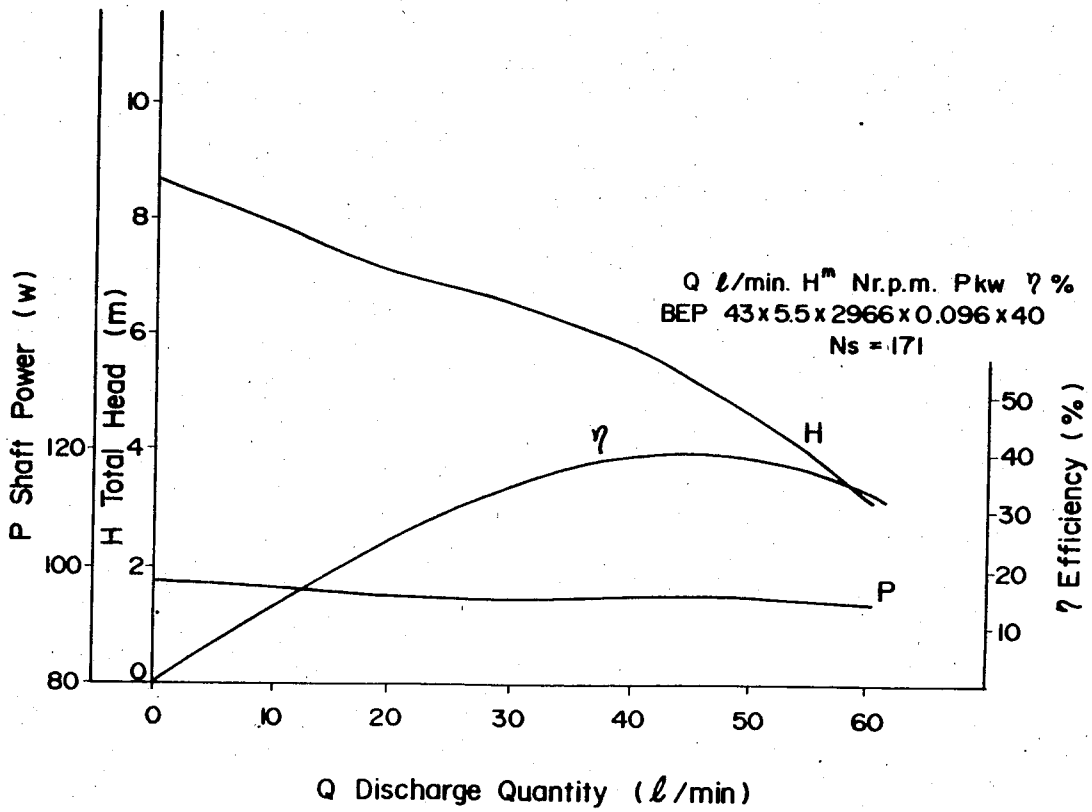
FIG. 6 is characteristic curves of the centrifugal pump according to the invention based on the results of experiments.

FIG. 6 shows the result of experiments conducted on the centrifugal pump according to the invention which is provided with the impeller 10 and the stationary guide vane 74. Table 1 shows the specifications of the impeller 10 used in the experiments. In the diagram shown in FIG. 6, the abscissa represents the discharge quantity Q and the ordinate indicates the brake force power P, total head H and efficiency $\eta$. Calculation done on the data obtained by the experiments shows that the specific speed Ns has a value of 171. The efficiency $\eta$ of the pump has proved to be similar to that of the centrifugal pumps now available commercially.

TABLE 1

| | |
|---|---|
| Diameter of Impeller at the Inlet | 66 m/m |
| Diameter of Hub at the Inlet | 35 m/m |
| Maximum Diameter of Impeller at the Outlet | 85 m/m |
| Number of Blade | 1 |
| Convolutions of Blade | 1.5 |
| RPM of Pump | 2960 r.p.m. |

The results of experiments show that the impeller according to the invention enables a centrifugal pump to achieve the performance which is beyond the power of the design technology of pump impellers of the prior art to achieve.

The centrifugal pump according to the invention comprises a centrifugal impeller having at least one blade which, although it is substantially similar in configuration at the inlet to that of an axial impeller, is wound in a suitable number of convolutions and extends from the inlet to the outlet and is inclined forwardly toward the axis of rotation of the impeller at an increasingly greater angle in going from the inlet toward the outlet, and a stationary guide vane secured to the casing to operate in conjunction with the centrifugal impeller. The centrifugal impeller according to the invention has a high speed head which has not been realized by axial impellers of the prior art. Thus, the centrifugal pump provided with this type of centrifugal impeller used in combination with the stationary guide vane can achieve a high pumping performance.

What is claimed is:

1. In a centrifugal pump of the type comprising a casing:

an annular channel defining an inlet to said pump;

a centrifugal impeller arranged for rotation in said casing, said centrifugal impeller including a hub and at least one blade wound in convolutions on a peripheral surface of the hub; and a stationary guide vane which is secured to said casing in said annular fluid channel at the pump inlet, said vane extending parallel and radially with respect to the axis of rotation of the impeller and located immediately before the impeller, the improvement comprising said centrifugal impeller having a fluid flow entrance surface substantially parallel to a blade inlet plane and substantially perpendicular to the axis of rotation of the impeller, said blade inlet plane being a plane formed by the blade inlet when the impeller is rotated, said blade being wound in a suitable number of convolutions extending from an inlet to an outlet of the blade on the hub and being forwardly inclined toward the axis of rotation of the impeller at an increasingly greater angle in going from the inlet toward the outlet of the blade, the angle of inclination of the blade with respect to the axis of rotation of the impeller being arbitrarily selected from the range between 0 and 90 degrees, and the convolutions of said blade define on the hub one or more fluid channels which are nearly equal in cross-sectional area.

2. A centrifugal pump as claimed in claim 1, wherein said impeller has 2 to 4 blades.

3. A centrifugal pump as claimed in claim 2, wherein said blade has a length such that it is wound in more than one-half convolutions which define a fluid channel on the hub.

* * * * *